US005628537A

United States Patent [19]

Kiemer

[11] Patent Number: 5,628,537

[45] Date of Patent: May 13, 1997

[54] PET WASTE PICKUP AND DISPOSAL APPARATUS

[76] Inventor: Ralph F. Kiemer, 4645 NW. 41 St., Lauderdale Lakes, Fla. 33319

[21] Appl. No.: 608,769

[22] Filed: Feb. 29, 1996

[51] Int. Cl.[6] ..... A01K 29/00; E01H 1/12

[52] U.S. Cl. ..... 294/1.4; 294/19.1

[58] Field of Search ..... 294/1.3, 1.4, 1.5, 294/19.1, 115; 15/104.8, 257.6; 224/600

[56] References Cited

U.S. PATENT DOCUMENTS

| | | | |
|---|---|---|---|
| 3,328,066 | 6/1967 | Johnston | 294/19 |
| 3,617,084 | 11/1971 | Mares | 294/1.4 |
| 3,738,697 | 6/1973 | Kahan | 294/19 R |
| 3,912,316 | 10/1975 | Veach | 294/1 R |
| 3,929,363 | 12/1975 | Kahan | 294/19 R |
| 4,014,584 | 3/1977 | Bau | 294/19 R |
| 4,097,082 | 6/1978 | Orofino | 294/1.4 |
| 4,179,145 | 12/1979 | Shinsako | 294/19 R |
| 4,466,647 | 8/1984 | Spevak | 294/1.5 |
| 4,477,111 | 10/1984 | Crooks | 294/1 BA |
| 4,878,703 | 11/1989 | Yoshioka | 294/1.5 |
| 4,962,956 | 10/1990 | Scripter | 294/1.4 |
| 4,995,661 | 2/1991 | Aurness et al. | 294/1.4 |
| 5,335,952 | 8/1994 | Clapper | 294/1.4 |
| 5,350,208 | 9/1994 | Heinrichson | 294/1.4 |

FOREIGN PATENT DOCUMENTS

| | | | |
|---|---|---|---|
| 2611-431 | 9/1988 | France | 294/1.4 |
| 2650-608 | 2/1991 | France | 294/1.4 |

*Primary Examiner*—Dean Kramer
*Attorney, Agent, or Firm*—Alvin S. Blum

[57] ABSTRACT

A device for scooping up animal waste and sealing it in an ordinary plastic film bag has a long handle for one handed operation at a distance from the waste. At one end of the handle is a pair of openable and closable jaws. The closed end of the bag is secured to a releasable clip between the jaws. The open end of the bag is everted over the free edges of the jaws. The open jaws with the open bag stretched between is then placed over the waste and the jaws closed, thus scooping the waste into the bag. The edges of the bag are then removed from the jaws and sealed with a tie. A locking mechanism keeps the jaws closed until ready to dispose of the sealed bag. The opening and closing and locking of the jaws may be performed with one hand by an operator mechanism located away from the jaws.

5 Claims, 1 Drawing Sheet

PET WASTE PICKUP AND DISPOSAL APPARATUS

FIELD OF THE INVENTION

This invention relates to animal waste pick up devices and more particularly to such devices that also enclose the waste in a throw away container in a sanitary manner.

BACKGROUND OF THE INVENTION

With the increased public concern over sanitation and a cleaner environment, many municipalities have required that dog owners clean up after their animals have defecated on public property. Although this is more pleasant for the public, it leaves the dog owner with an extremely unpleasant daily task. Various scooping devices have been provided to hold a bag open while the feces are scraped or scooped therein. These put the user into unpleasant proximity with the offending material and leave a bag with a soiled edge to be carried about during the walk. Some devices employ special disposable rigid boxes that are expensive and may not be readily available. Every market carries ordinary thin film polymer bags. These are inexpensive, somewhat resilient, impermeable to moisture and odor, and readily sealed with a twist tie. If a device could be provided that would encapsulate the feces in one of these bags without soiling the outer edge of the bag, while the user is at the other end of a long handle, it would remove much of the unpleasantness and indignity to which many dog owners are now subjected.

SUMMARY OF THE INVENTION

It is accordingly an object of the invention to provide a device for picking up animal waste that keeps the operator remote from the waste during the process and that packages the waste into an ordinary inexpensive plastic film disposable bag. It is another object that the bag present an unsoiled outer surface after the waste has been enclosed therein for sanitary disposal. It is yet another object that the device may be prepared with the bag in position before leaving home so that the pick up process may be easily performed with one hand while holding a leash in the other hand.

The device of the invention comprises a pair of jaws pivotally attached to one end of a long handle, an elongate sleeve around the handle is connected to the jaws such that sliding the sleeve away from the jaws opens them up and sliding the sleeve or jaw operator toward the jaws closes them. Rotating the sleeve about the long axis of the handle in one direction locks the sleeve against sliding movement.

When the jaws are locked open, a bag clip engages the closed end of an ordinary thin film plastic bag while the open end of the bag is everted over the edges of the jaws. The device is now prepared for one handed operation while holding a leash in the other. To pick up the dog feces, the user positions the open bag over the waste, makes jaw contact with the ground, rotates the sleeve to unlock the sliding motion, and moves the sleeve downward on the handle. This closes the jaws and encloses the waste within the bag. The jaws may be locked closed to continue the walk. At some point the bag open end is removed from the closed jaws and sealed, such as by a lock seal or twist tie. Then the jaws may be opened and the sealed bag disposed of.

These and other objects, advantages and features of the invention will become more apparent when the detailed description is studied in conjunction with the drawings in which like reference characters designate like elements in the various figures.

DETAILED DESCRIPTION OF PREFERRED EMBODIMENT

Figure 5:
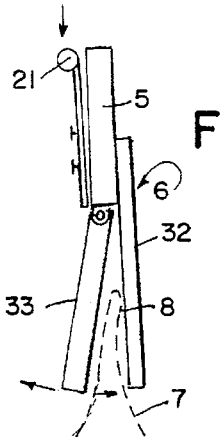
FIG. 5 is a detail of bag clip mechanism.

Referring now first to FIGS. 1–5, the device 27 comprises an elongate handle 1 having a long axis 2 and a first end 3 to which is attached a jaw assembly 5. A bag clip 6, best seen in the detail of FIG. 5, is attached to the jaw assembly including a fixed plate 32 and a hingedly attached movable plate 33. A bag clip lever 21 slidably connected to the jaw assembly, when forced over plate 33 tightly engages the closed end 8 of the ordinary plastic film bag 7, shown in phantom. The two opposed jaws 10 each have a proximal end 11 hingedly connected to the jaw assembly 5. The distal end 12 of each jaw terminates in a wide edge 13 extending transverse to the long axis 2. The planar edge 13 may optionally be provided with serrations 20 lying in the plane so that the device may more effectively scoop up waste from irregular surfaces such as grass.

An elongate tubular jaw operator 15 is slidably mounted over the handle 1 with an aperture 34 in the operator permitting the second end 4 of the handle 1, in the form of a transverse bar, to pass therethrough. Rotatably mounted on operator 15 is carrier 35. A lever 26 is pivotally connected between each jaw 10 and the carrier 35, such that when operator 15 is pulled up relative to handle 1 the jaws open and when moved in the opposite direction, the jaws are drawn together. A termination 19 at the end of the operator enables a user to draw end 4 toward termination 19 with one hand to close the jaws.

The jaws are arranged to hold the open end 9 of the bag 7 when the closed end 8 is held in the bag clip. The open end is everted over the jaws, forming a cuff 14, and the resilience of the plastic film holds it securely in place and wide open when the jaws are open and bag clip 6 is holding the closed end up so that even in a high wind there is no difficulty in positioning the open bag over the waste and scooping the waste into the bag by closing the jaws with one hand remote from the waste. Because the open end of the bag is everted over the jaws, the edge of the bag that may contact the feces will be inside the bag and not at the bag edge so that the user may remove the edge of the bag from the jaws and seal the bag with a twist tie 36 without soiling the hands. Other bag sealing means well known in the art may alternatively be employed such as self locking, drawstring and the like. The jaws may be locked in closed or open condition by locking means well known in the art. Locking means 17 shown here is exemplary of the art and is ordinarly used to look telescoping handles in place.

Figure 2:
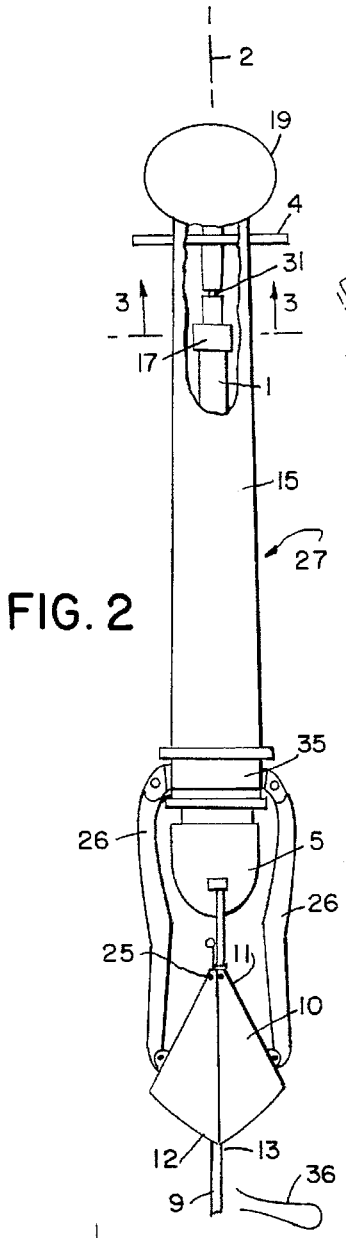
FIG. 2 is a side elevation view of the device of FIG. 1.
Figure 4:
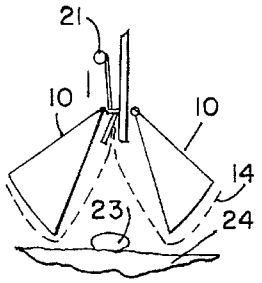
FIG. 4 is a side elevation detail of the device with jaws open and bag in place.
Figure 3:
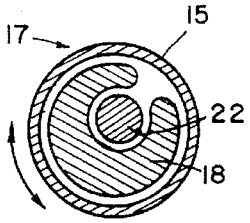
FIG. 3 is a sectional view taken through line 3—3 of FIG. 2 detailing the lock mechanism.
Figure 1:
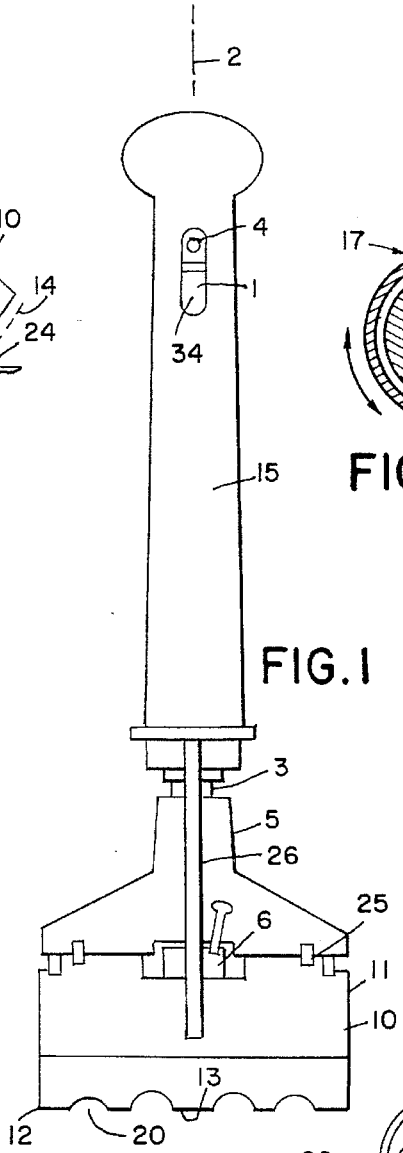
FIG. 1 is a front elevation view of the device of the invention with jaws closed.

As best seen in FIG. 3, a springy plastic sleeve cam element 18 has a large enough outer diameter to releasably engage the inside of tubular jaw operator 15 so that it may slide up and down. The inner circumference of cam element 18 is eccentric to its outer circumference. Element 18 is rotatably mounted on a cylindrical portion 22 of the handle having a reduced diameter that is eccentric to long axis 2. As the operator is rotated in one direction about the long axis relative to the handle, the cam element jams tightly between handle and operator, locking against translatory motion and preventing opening or closing of the jaws.

When waste has been scooped up and sealed in the bag, the jaws may be locked closed and the walk completed without concern of dropping the bag until the user is ready to dispose of the bag. By holding the jaws against the ground 24, the termination 19 may be rotated for remote locking and unlocking. Swivel 31 in elongate handle 1 enables the operator 15 and second end 4 of the handle to rotate without rotating the jaw assembly.

Figure 6:
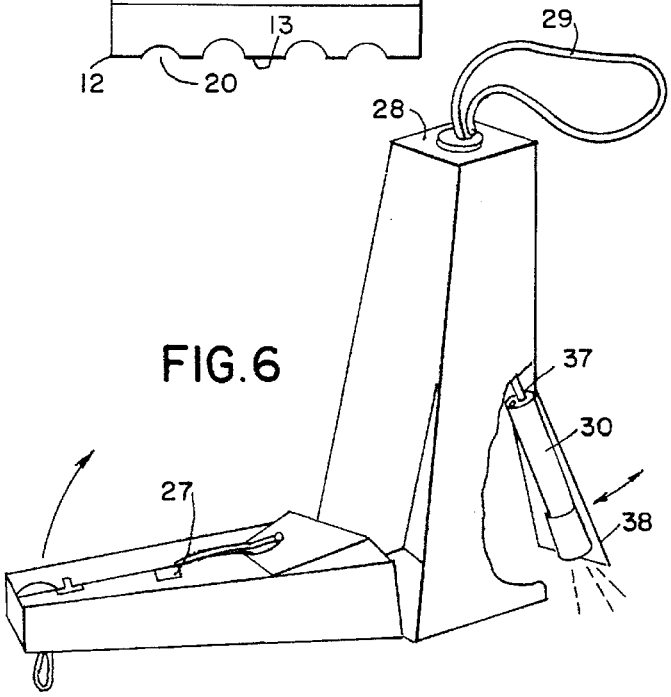
FIG. 6 is a perspective view of the device in the special carrier.

Referring now to FIG. 6, a specially constructed carrier 28 for the device 27 has an elongate carrying strap or cord 29 for hands free carrying on the shoulder. The carrier may be opened and closed with one hand without removing from the shoulder.

A flashlight 30 is hingedly mounted within the carrier, and is provided with automatic switch 37 that turns on the light when door 38 is opened to illuminate the scooping activity.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention.

What is claimed is:

1. An animal waste packaging and pick up device comprising:

an elongate handle having a long axis, an outer surface, a first end and a second end;

a jaw assembly attached to the first end;

a bag clip attached to the jaw assembly, the bag clip adapted for removably engaging a closed end of a thin film plastic bag;

a first jaw and a second jaw, each jaw having a proximal end pivotally attached to the jaw assembly and a distal end terminating in a wide edge extending transverse to the long axis, the distal ends adapted to removably retain thereon the everted open end of said plastic bag, while the closed end is engaged by the bag clip;

a jaw operator slidably mounted on the handle for motion along the long axis, the jaw operator operatively connected to the jaws for moving the jaws between a first, open position in which the distal ends are spaced apart such that said bag may be positioned wide open over the animal waste, and a second, closed position by a downward motion of the operator relative to the handle in which the distal ends are drawn together, thereby closing the bag and enclosing the waste therein, whereupon the everted, unsoiled outer edges of said bag may be removed from the jaws and sealed before the jaws are opened and the bag clip disengaged; and locking means for preventing slidable movement between the handle and the operator, the locking means operatively connected between the handle and the operator.

2. An animal waste packaging and pick up device comprising:

an elongate handle having a long axis, an outer surface, a first end and a second end;

a jaw assembly attached to the first end;

a bag clip attached to the jaw assembly, the bag clip adapted for removably engaging a closed end of a thin film plastic bag;

a first jaw and a second jaw, each jaw having a proximal end pivotally attached to the jaw assembly and a distal end terminating in a wide edge extending transverse to the long axis, the distal ends adapted to removably retain thereon the everted open end of said plastic bag, while the closed end is engaged by the bag clip;

a jaw operator slidably mounted on the handle for motion along the long axis, the jaw operator operatively connected to the jaws for moving the jaws between a first, open position in which the distal ends are spaced apart such that said bag may be positioned wide open over the animal waste, and a second, closed position by a downward motion of the operator in which the distal ends are drawn together, thereby closing the bag and enclosing the waste therein, whereupon the everted, unsoiled outer edges of said bag may be removed from the jaws and sealed before the jaws are opened and the bag clip disengaged; and locking means for preventing slidable movement between the handle and the operator, the locking means operatively connected between the handle and the operator, in which the locking means comprises a cam element actuated by relative rotation between the jaw operator and the handle about the long axis.

3. An animal waste packaging and pick up device comprising:

an elongate handle having a long axis, an outer surface, a first end and a second end;

a jaw assembly attached to the first end;

a bag clip attached to the jaw assembly, the bag clip adapted for removably engaging closed end of a thin film plastic bag;

a first jaw and a second jaw, each jaw having a proximal end pivotally attached to the jaw assembly and a distal end terminating in a wide edge extending transverse to the long axis, the distal ends adapted to removably retain thereon the everted open end of said plastic bag, while the closed end is engaged by the bag clip;

a jaw operator slidably mounted on the handle for motion along the long axis, the jaw operator operatively connected to the jaws for moving the jaws between a first, open position in which the distal ends are spaced apart such that said bag may be positioned wide open over the animal waste, and a second, closed position by a downward motion of the operator in which the distal ends are drawn together, thereby closing the bag and enclosing the waste therein, whereupon the everted, unsoiled outer edges of said bag may be removed from the jaws and sealed before the jaws are opened and the bag clip disengaged;

locking means for preventing slidable movement between the handle and the operator, the locking means operatively connected between the handle and the operator, in which the locking means comprises a cam element actuated by relative rotation between the jaw operator and the handle about the long axis; and in which the jaw operator is slidably mounted on the outer surface of the handle and extends to a termination beyond the second end of the handle, such that a downward thrust on the jaw operator while the jaws are in contact with a supporting surface supporting the waste will enable the locking means to be actuated by simple one handed rotation of the jaw operator and a simple one handed drawing of the termination and the second end together will close the jaws, the entire procedure being performed remote from the waste.

4. The device according to claim 3, in which the wide edges of the jaws are provided with serrations to enhance waste collection on an uneven surface.

5. The device according to claim 3 further comprising a carrier means for totally enclosing and carrying about the device in a sanitary manner with waste enclosed and sealed within said bag, the carrier means provided with an elongate strap or cord for hands-free carrying and a flashlight for hands-free illumination of the waste.

* * * * *